US010307880B1

(12) United States Patent
Richards

(10) Patent No.: US 10,307,880 B1
(45) Date of Patent: Jun. 4, 2019

(54) FLOOR GRINDER AND POLISHER

(71) Applicant: POLYROCK LLC, Medford, NJ (US)

(72) Inventor: Bradley Richards, Medford, NJ (US)

(73) Assignee: POLYROCK LLC, Medford, NJ (US)

( * ) Notice: Subject to any disclaimer, the term of this patent is extended or adjusted under 35 U.S.C. 154(b) by 0 days.

(21) Appl. No.: 15/663,087

(22) Filed: Jul. 28, 2017

Related U.S. Application Data

(60) Provisional application No. 62/416,433, filed on Nov. 2, 2016.

(51) Int. Cl.

| | |
|---|---|
| ***B24B 7/18*** | (2006.01) |
| ***B24B 41/02*** | (2006.01) |
| ***B24B 51/00*** | (2006.01) |
| ***A47L 11/14*** | (2006.01) |
| ***A47L 11/40*** | (2006.01) |

(52) U.S. Cl.
CPC ..... *B24B 7/186* (2013.01); *A47L 11/14* (2013.01); *A47L 11/4011* (2013.01); *B24B 41/02* (2013.01); *B24B 51/00* (2013.01)

(58) Field of Classification Search
CPC ..... B24B 7/186; B24B 41/02; B24B 51/00; A47L 11/14
USPC ..... 451/73, 353; 180/11, 12, 13, 19.1, 19.2, 180/19.3; 299/39.4, 39.2, 39.1
See application file for complete search history.

(56) References Cited

U.S. PATENT DOCUMENTS 2,323,345 A * 7/1943 Moore ..... E01C 19/203 239/657
2,923,107 A * 2/1960 Biasoni ..... B24B 7/186 144/118
3,264,674 A * 8/1966 Doyle, Jr. ..... B24B 7/186 299/41.1
3,744,068 A * 7/1973 Harris ..... A47C 19/04 248/408
3,802,742 A * 4/1974 Zuzelo ..... A47L 11/162 15/320
3,896,989 A * 7/1975 Ellis ..... E01C 23/088 299/39.2
4,273,384 A * 6/1981 Freeburn ..... E01C 23/088 280/442
4,334,335 A * 6/1982 Brown ..... E01C 23/0885 172/327
4,348,783 A * 9/1982 Swanson ..... A47L 11/30 15/319

(Continued)

OTHER PUBLICATIONS

Product catalog for "HTC 2500 iX—Industrialized, The first ever mobile grinding system", https://web.archive.org/web/20160902154819/http://www.htc-floorsystems.com:80/en/Products/GrindingMachines/HTC2500iX.aspx, Sep. 2, 2016, 3 pages.

*Primary Examiner* — George B Nguyen
(74) *Attorney, Agent, or Firm* — Reed Smith LLP; Matthew P. Frederick

(57) ABSTRACT

An apparatus for treating a floor surface includes a floor grinder-polisher system including a support frame and a plurality of grinding heads mounted on the support frame, a power source connected to the plurality of grinding heads and configured to supply power to the plurality of grinding heads, a controller configured to control the plurality of grinding heads, and a vehicle connected to the support frame and configured to support the power source. Each grinding head includes a grinding surface configured to rotate and engage a floor surface.

29 Claims, 8 Drawing Sheets

(56) References Cited

U.S. PATENT DOCUMENTS

| | | | | | |
|---|---|---|---|---|---|
| 4,363,151 | A * | 12/1982 | Knowlton | A47L 11/30 | 15/320 |
| 5,901,410 | A * | 5/1999 | Windmeisser | A47L 11/24 | 15/83 |
| 6,202,775 | B1 * | 3/2001 | Mattson | A47L 11/30 | 15/320 |
| 6,494,542 | B1 * | 12/2002 | Watt | B24B 7/186 | 180/12 |
| 7,261,623 | B1 * | 8/2007 | Palushi | B24B 7/186 | 451/350 |
| 7,674,158 | B2 * | 3/2010 | Crocker | E01H 1/103 | 299/39.4 |
| 8,839,479 | B2 * | 9/2014 | Hruby | A47L 11/1625 | 15/49.1 |
| 2006/0073776 | A1 * | 4/2006 | Gallup | B24B 7/188 | 280/503 |
| 2007/0264917 | A1 * | 11/2007 | Lundberg | B24B 7/186 | 451/353 |
| 2010/0136890 | A1 * | 6/2010 | Strickland | B24B 7/186 | 451/73 |
| 2014/0027605 | A1 * | 1/2014 | Chow | E06C 7/426 | 248/689 |
| 2014/0217803 | A1 * | 8/2014 | O'Sullivan | A47C 7/383 | 297/464 |
| 2016/0151874 | A1 * | 6/2016 | Jensen | B24B 1/00 | 451/32 |
| 2016/0221143 | A1 * | 8/2016 | Dickson | B24B 7/186 | |
| 2017/0145705 | A1 * | 5/2017 | Lange | B08B 3/024 | |

* cited by examiner

FLOOR GRINDER AND POLISHER

CROSS-REFERENCE TO RELATED APPLICATIONS

This application claims priority to U.S. Provisional Application, Ser. No. 62/416,433, entitled "FLOOR GRINDER AND POLISHER," filed on Nov. 2, 2016, the entire contents of which is hereby incorporated by reference.

TECHNICAL FIELD

This disclosure relates to grinding and polishing treatment of floor surfaces, e.g., concrete floor surfaces.

BACKGROUND

Floor surfaces, such as concrete floor surfaces, can be treated with a floor treatment system that grinds or polishes a floor surface. Floor treatment systems incorporating a grinding and polishing machine are used to grind and polish floor surfaces, such as concrete floor surfaces, to a finished floor surface. Grinding and polishing machines sometimes include a grinding and polishing head with a rotating friction surface to engage a floor surface. Typically, a grinding and polishing head is mounted on a frame with one or two other grinding and polishing heads, and the frame and heads constitute a walk-behind polishing and grinding machine that is pushed by an operator during operation.

SUMMARY

This disclosure describes floor surface treatments, for example, for grinding and polishing a floor surface.

In some aspects of the disclosure, an apparatus for treating a floor surface includes a floor grinder-polisher system including a support frame and a plurality of grinding heads mounted on the support frame, a power source connected to the plurality of grinding heads and configured to supply power to the plurality of grinding heads, a controller configured to control the plurality of grinding heads, and a vehicle connected to the support frame and configured to support the floor grinder-polisher system and the power source.

This, and other aspects, can include one or more of the following features. Each grinding head in the plurality of grinding heads can include a grinding surface configured to rotate and engage a floor surface. The controller can be configured to independently control a rotational speed of each grinding surface of the grinding heads. Each grinding head in the plurality of grinding heads can include an electric motor or a hydraulic motor configured to rotate a respective grinding surface of each grinding head. The grinding surface can include at least one of diamond cutters or carbide cutters. The grinding surface of one grinding head in the plurality of grinding heads can include about 24 diamond cutters. Each grinding head in the plurality of grinding heads can be independently mounted on the support frame. Each grinding head can be adjustable on the support frame. Each grinding head in the plurality of grinding heads can be removably connected to the support frame. The plurality of grinding heads can include at least five grinding heads mounted on the support frame. Three or more grinding heads of the at least five grinding heads can be disposed on the support frame in a staggered, zig-zag pattern. The apparatus can include at least one weight tray disposed on at least one grinding head of the plurality of grinding heads, the at least one weight tray configured to provide an additional downforce on the at least one grinding head of the plurality of grinding heads. The support frame can be removably connected to the vehicle. The support frame can removably connect to the vehicle with a hitch pin system. The support frame can be adjustable. The support frame can include extendible arms configured to adjust a lateral width of the support frame. The power source can be mounted directly on the vehicle. The power source can be mounted on a tow cart connected to the vehicle, the tow cart configured to be towed by the vehicle. The power source can include a generator configured to supply electric power to the plurality of grinding heads. The generator can be a 200 amp to 250 amp generator. A drive system of the vehicle can include a chain driven sprocket. The vehicle can include three or more wheels. The wheels can include non-marking tires. The apparatus can include a control panel proximate the power source and electrically connected between the power source and the plurality of grinding heads, the control panel configured to house the controller. The apparatus can include a breaker box electrically connected between the power source and the plurality of grinding heads. The apparatus can include a water management system including a water tank and a water supply hose, the water management system configured to supply water to the floor grinder-polisher system. The water supply hose can be at least partially integral to the vehicle. The water tank can be disposed on a tow cart configured to be towed by the vehicle. The apparatus can include a vacuum system supported by the vehicle. The controller can be configured to control at least one of a speed of the plurality of grinding heads, a speed of the vehicle, or flow rate of water supplied to the plurality of grinding heads from the water management system. The controller can be configured to provide speed and load readings of the plurality of grinding heads. The support frame can connect to the vehicle at a front end of the vehicle.

In some aspects of the disclosure, an apparatus for treating a floor surface include a floor grinder-polisher system including a support frame and at least one grinding head mounted on the support frame, a power source electrically connected to the at least one grinding head and configured to supply power to the at least one grinding head, and a vehicle configured to support the floor grinder-polisher system and the power source. This, and other aspects, can include one or more of the following features. The power source can be mounted on the vehicle. The power source can be mounted on a tow cart connected to the vehicle, the tow cart configured to be towed by the vehicle. The power source can include a generator configured to supply electric power to the at least one grinding head. Each grinding head in the at least one grinding head can include a 30 horsepower electric motor, and the generator can include a 200 amp to 250 amp generator. The support frame can be removably connected to the vehicle. The support frame can removably connect to the vehicle by a hitch pin system. The at least one grinding head can be removably connected to the support frame. The at least one grinding head can include five or more grinding heads, and at least three grinding heads of the five or more grinding heads can be disposed on the support frame in a staggered, zig-zag pattern.

In some aspects of the disclosure, a method for treating a floor surface includes providing a floor treatment apparatus including a floor grinder-polisher system having a support frame and a plurality of grinding heads supported by the support frame, a power source connected to the at least one grinding head, and a vehicle connected to the support frame and supporting the floor grinder-polisher system and the power source, and supplying power to the plurality of grinding heads from the power source mounted directly on the vehicle.

This, and other aspects, can include one or more of the following features. The method can include at least one of grinding or polishing a floor surface with the plurality of grinding heads. Supplying power to the plurality of grinding heads can include supplying electric power to a plurality of electric motors of the plurality of grinding heads. The method can include disconnecting the support frame from the vehicle. The method can include controlling, with a controller, a rotational speed of grinding surfaces of the plurality of grinding heads. The controller can be configured to independently control each grinding head in the plurality of grinding heads. The method can include controlling, with the controller, a speed of the vehicle.

In some aspects of the disclosure, an apparatus for treating a floor surface includes a floor grinder-polisher system having a support frame and a plurality of grinding heads mounted on the support frame. Each grinding head includes a grinding surface configured to rotate and engage a floor surface. The apparatus further includes a power source connected to the plurality of grinding heads and configured to supply power to the plurality of grinding heads, a controller configured to control the plurality of grinding heads, and a vehicle connected to the support frame and configured to support the power source.

This, and other aspects, can include one or more of the following features. The controller can be configured to independently control a rotational speed of each grinding surface of the plurality of grinding heads. Each grinding head in the plurality of grinding heads can include a motor configured to rotate a respective grinding surface of each grinding head. The motor can be an electric motor. The grinding surface of one grinding head in the plurality of grinding heads can include about 24 diamond cutters. Each grinding head of the plurality of grinding heads can be independently mounted on the support frame. Each grinding head can be adjustable on the support frame. Each grinding head of the plurality of grinding heads can be removably connected to the support frame. The grinding heads can include at least five grinding heads mounted on the support frame. Three or more grinding heads of the five grinding heads are disposed on the support frame in a staggered, zig-zag pattern. The apparatus can include a weight tray disposed on at least one of the grinding heads, the weight tray configured to provide an additional downforce on the grinding heads. The support frame can be removably connected to the vehicle. The support frame can removably connect to the vehicle with a hitch pin system. The support frame can rotatably connect to the vehicle. The support frame can be adjustable in length between a first lateral side and a second, opposite lateral side of the support frame. The support frame can include extendible arms configured to adjust the length of the support frame. The apparatus can include a water management system including a water tank and a water supply hose, where the water management system supplies water to the floor grinder-polisher system for a wet-grinding operation. The water supply hose can be at least partially integral to the vehicle. The water tank can be disposed on a tow cart to be towed by the vehicle. The controller can control a flow rate of water supplied to the plurality of grinding heads from the water management system. The controller can control a speed of the grinding heads, a speed of the vehicle, or both. The controller can provide speed and load readings of the grinding heads to an indicator on the vehicle. Each grinding head can include a 30 horsepower electric motor, and the power source can include a 200 amp to 250 amp generator.

In some aspects of the disclosure, a method for treating a floor surface includes supporting, with a vehicle, a floor grinder polisher system and a power source. The floor grinder polisher system includes a support frame and a plurality of grinding heads mounted on the support frame, each grinding head in the plurality of grinding heads including a grinding surface configured to rotate and engage a floor surface. The method includes supplying power, with the power source, to the plurality of grinding heads, engaging, with the plurality of grinding heads, a floor surface, and controlling, with a controller, a speed of the plurality of grinding heads.

This, and other aspects, can include one or more of the following features. Controlling a speed of the plurality of grinding heads can include controlling, with the controller, a rotational speed of the grinding surfaces of the plurality of grinding heads. Controlling a speed of the plurality of grinding heads can include independently controlling, with the controller, each grinding head of the plurality of grinding heads.

In some aspects of the disclosure, an apparatus for treating a floor surface includes a floor grinder-polisher system including a support frame and at least one grinding head removably connected to the support frame, where the at least one grinding head includes a grinding surface configured to rotate and engage a floor surface. The apparatus includes a power source connected to the floor grinder-polisher system and configured to supply power to the at least one grinding head, a controller configured to control the plurality of grinding heads, and a vehicle connected to the support frame and configured to support the power source. The support frame can be removably connected to the vehicle.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
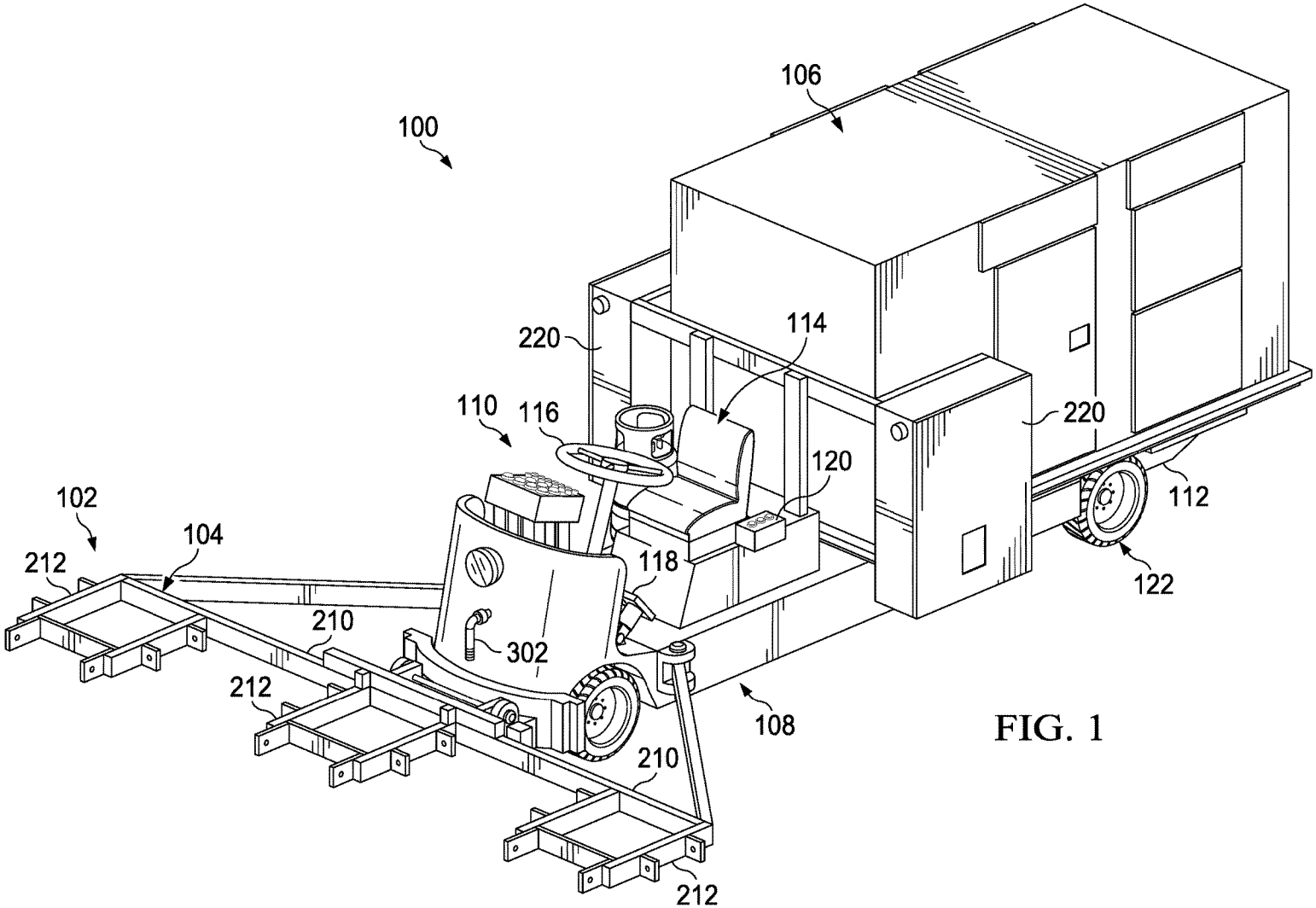
FIG. 1 is an orthogonal views of an example floor treatment system.

This disclosure describes a floor surface treatment system for grinding and polishing a floor surface, such as concrete, terrazzo, tile mastic, and/or other floor surfaces. The floor surface can be indoors or outdoors, and the floor surface treatment system may not be limited by environmental conditions. A floor surface (e.g., a new concrete floor surface, a floor surface with abrasions, voids, or other flaws, and/or other floor surfaces) can undergo a floor treatment operation to grind and/or polish the floor surface, for example, to achieve a smooth finished floor surface. This disclosure describes a floor surface treatment system with one or more grinding heads (e.g., one to seven grinding heads) mounted on a support frame, where the support frame is connected to and driven by a vehicle. In some implementations, the floor surface treatment system includes a power source (e.g., generator) mounted on, towed by, or otherwise connected to the vehicle to power the grinding heads on the support frame.

In conventional floor treatment systems, a grinding machine includes one to three grinding heads mounted on a walk-behind frame meant to be pushed by an operator walking behind the grinding machine. Also, in some conventional floor treatment systems, the grinding heads are connected to a remote, distanced power source via long power cables extending between the movable grinding machine and the stationary, remote power source. However, this disclosure describes a floor treatment system including a vehicle, where the power source and the support frame holding the grinding heads are supported and driven by the vehicle, and where the vehicle can be driven by an operator. The vehicle can include a steering configuration, such as a steering wheel, a joystick, two separate throttles that control the rotational speed and direction of drive wheels, or another steering configuration, an accelerator for manual control by an operator, and/or can include one or more controllers to control speed, direction, and/or other aspects of the vehicle, for example, based on parameters of a grinding and polishing operation of the grinding heads.

In some implementations, a floor treatment system that holds about seven (e.g., 5 to 7) grinding heads can treat a larger amount of floor surface with added consistency and in the same or less time than, for example, a conventional one- to three-grinding head treatment system. In some examples, mounting a power source on the vehicle or towing the power source behind the vehicle can reduce or eliminate the need for large, heavy power cables extending between a remote power source and the grinding heads, and avoids the risks and dangers of cutting the cables and/or running over the cables with the grinding machine and power loss associated with transmission over long cables. In certain implementations, a vehicle that can be controlled to operate at a constant speed and/or direction can produce a more consistent and even floor finish, for example, compared to a hand-push grinding machine where speed may not be consistent.

Figure 2:
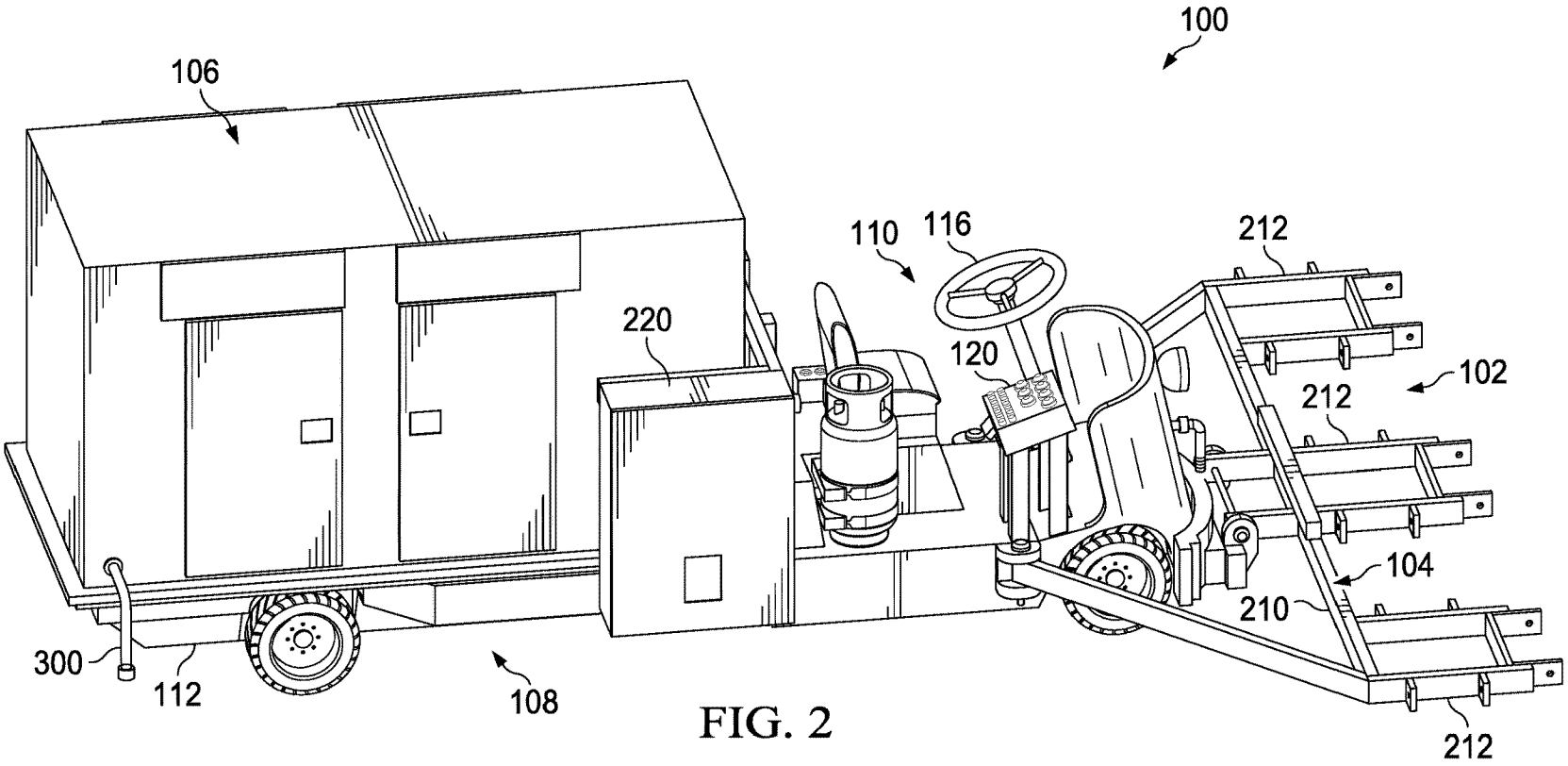
FIG. 2 is a side view of an example floor treatment system.

FIG. 1 is an orthogonal view of an example floor treatment system 100, and FIG. 2 is a side view of the example floor treatment system 100. The example floor treatment system 100 includes a floor grinder-polisher system 102 that includes a support frame 104 and one or more grinding heads (not shown) mounted on the support frame 104, a power source 106 connected to grinding heads and configured to supply power to the grinding heads, and a vehicle 108 connected to the support frame 104. The vehicle 108 connects to the floor grinder-polisher system 102 and supports the power source 106. In the example floor treatment system 100, the power source 106 is mounted directly on a bed of the vehicle 108. In some implementations, the power source 106 is mounted on a tow cart connected to the vehicle 108, and the tow cart can be towed behind the vehicle 108 during a floor grinding and polishing operation performed by the example floor treatment system 100. In the example system 100 of FIGS. 1 and 2, the power source 106 is a generator configured to supply electric power to the one or more grinding heads. For example, the power source 106 can include a 200 amp to 250 amp generator, and each grinding head can include an electric motor powered by the generator. The size and/or capacity of the generator can vary, for example, based on the minimum and maximum loads of the grinding heads. In some implementations, the generator can be rated at less than 200 amps, greater than 200 amps, or anywhere at or between 200 and 300 amps. In some examples, the generator can be powered by propane fuel, which may be preferable for use in indoor environments where air quality is a particular concern. However, the generator can also be powered by other fuel sources, such as gasoline, diesel, or other fuels. In some instances, the floor treatment system 100 includes emission particulate apparatuses, commonly described as scrubbers or equal, to filter air, exhaust, or other. Although FIGS. 1 and 2 show the power source 106 as including a generator, the power source 106 can take a variety of forms. For example, the power source 106 can include a hydraulic system including a hydraulic pump, hydraulic fluid tank, one or more control valves, and respective hydraulic lines extending to respective grinding heads.

The vehicle 108 can take a variety of forms. For example, the vehicle 108 of the example floor treatment system 100 of FIGS. 1 and 2 includes an operator cab 110 and a storage bed 112. The storage bed 112 of the example system 100 supports the power source 106 (e.g., generator), and can include mounting brackets, support plates, tie-downs, a security frame, and/or other structures to mount, support, and/or secure the power source 106 on the storage bed 112 of the vehicle 108. In some examples, the vehicle 108 is rated to support a weight of the power source 106 and an operator of the vehicle 108, and/or the vehicle 108 is rated to tow the weight of the power source 106 and an associated tow cart. For example, the vehicle 108 can be rated to directly support a generator up to 6,250 pounds on the storage bed 112 of the vehicle 108. The example operator cab 110 includes a seat 114, steering wheel 116, accelerator and brake pedals 118, and operator controls 120. The vehicle 108 also includes three or more wheels 122 (e.g., four wheels), for example, with non-marking tires to substantially or completely prevent tire marking of a floor surface on which the vehicle 108 is moving. In some implementations, the vehicle 108 includes a chain-driven drive system, a belt-driven drive system, an electric drive system, and/or a hydraulic drive system. In the example vehicle 108 of FIGS. 1 and 2, the drive system is chain-driven, which is less prone to breakage or maintenance than, for example, a belt-driven drive system or a hydraulic drive system. By way of further example, the breakage of a hydraulic drive system may result in the leakage of hydraulic fluid on the floor surface causing damage to the floor surface and the system 100 itself. However, the drive system of the vehicle 108 can vary. The drive system of the vehicle 108 can be adjusted to fit a grinding and polishing operation. For example, sprockets of the drive system of the vehicle 108 can be adjusted to drive the vehicle 108 at an optimal speed for grinding and/or polishing (e.g., very slowly, for example, between 1 foot per second and 5 feet per second) to ensure sufficient grinding and/or polishing of a floor surface has occurred as the vehicle 108 is driven during a grinding and/or polishing operation.

Figure 3:
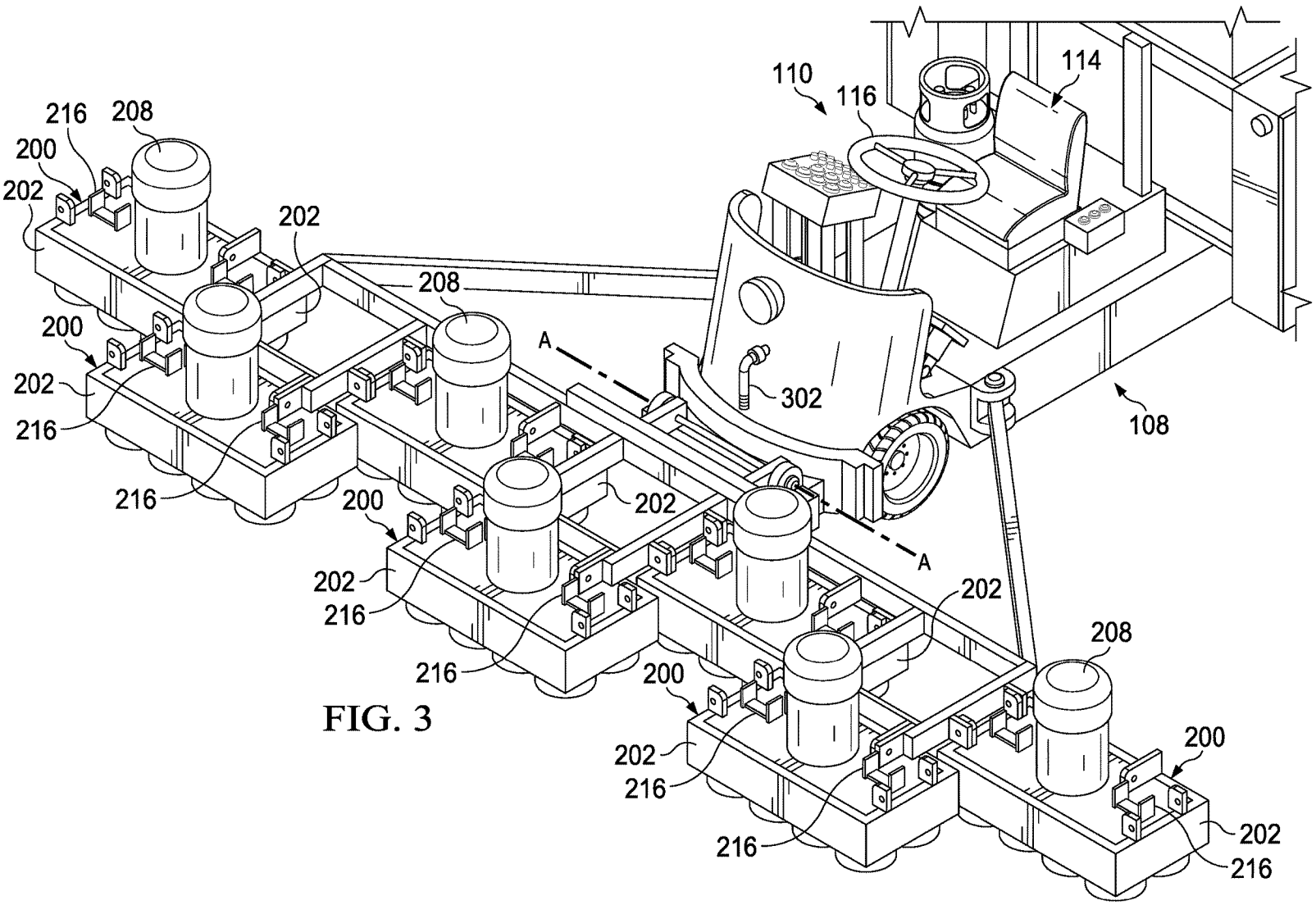
FIG. 3 is an upper side view of an example floor treatment system.
Figure 4A:
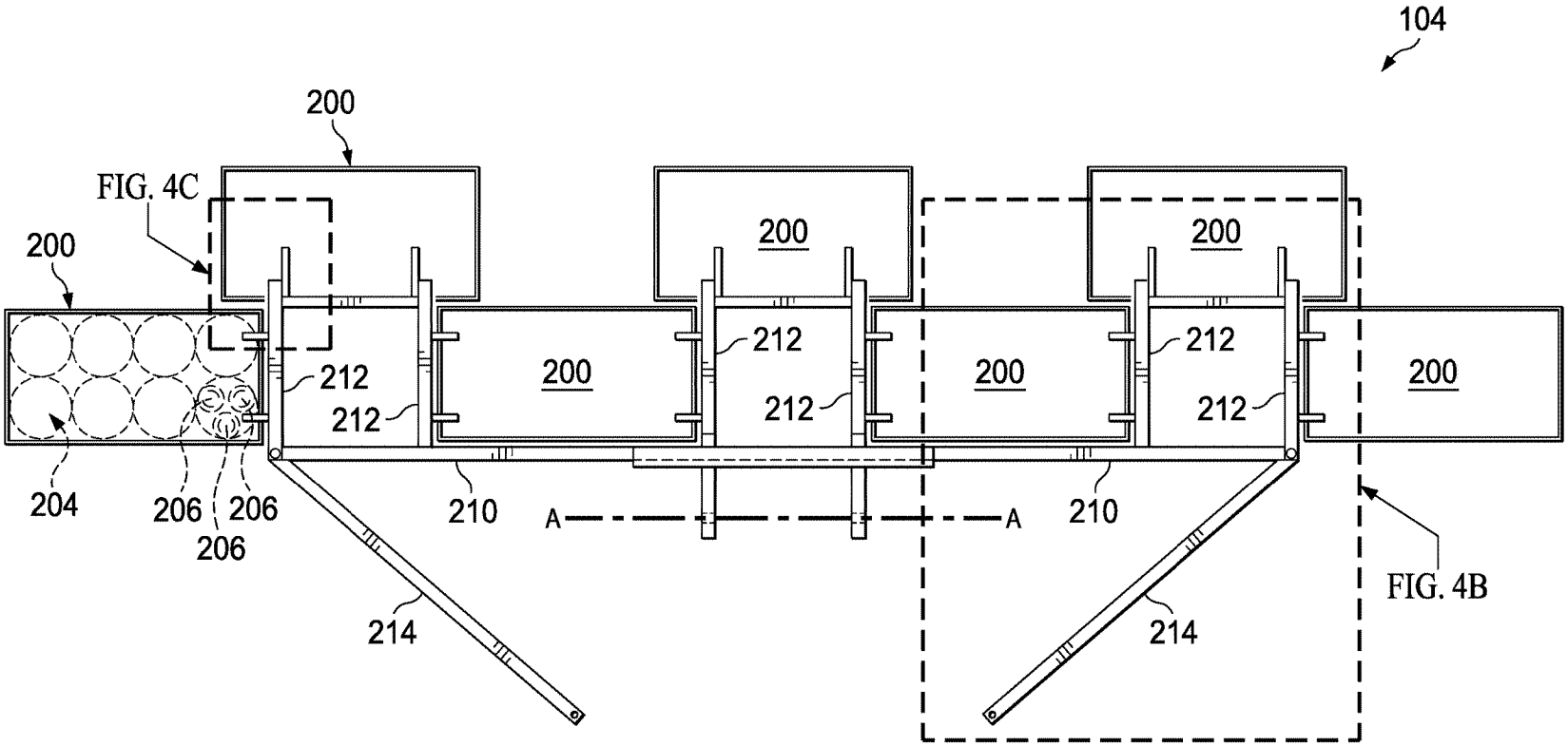
FIG. 4A is a schematic top view of an example support frame and grinding heads.
Figure 4C:
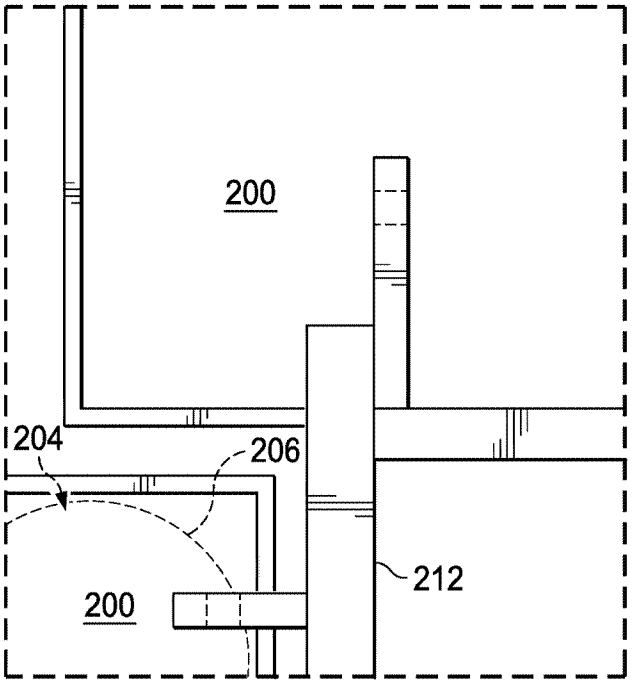
FIGS. 4B-4C are schematic partial top views of portions of the example support frame of FIG. 4A.
Figure 4B:
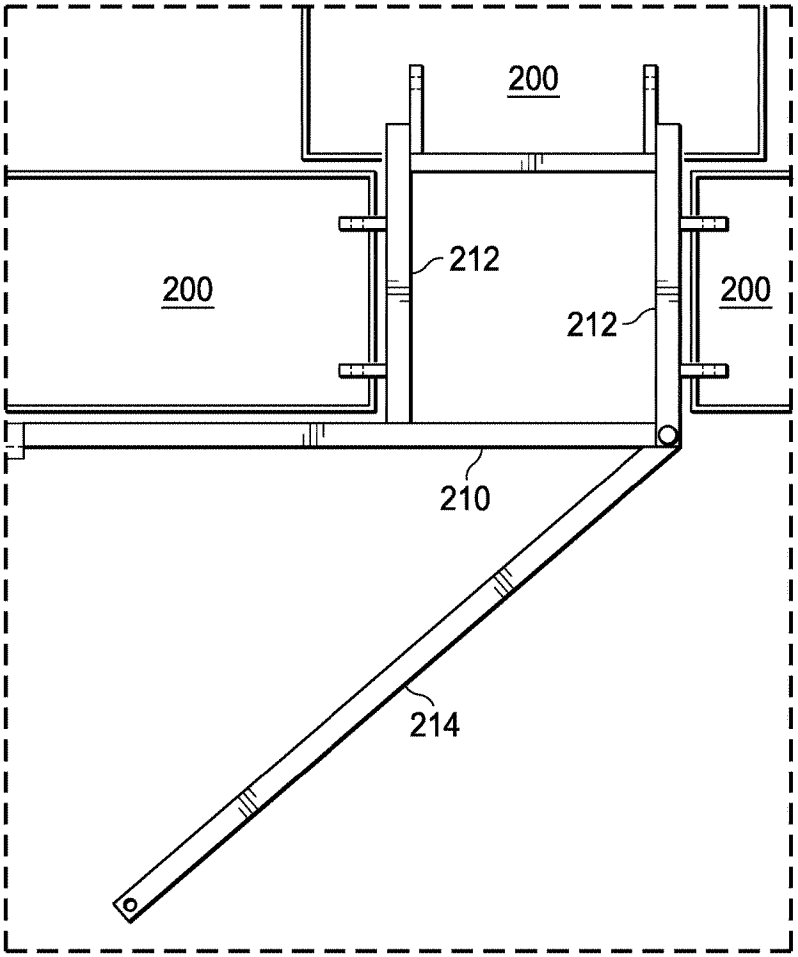
Figure 4D:
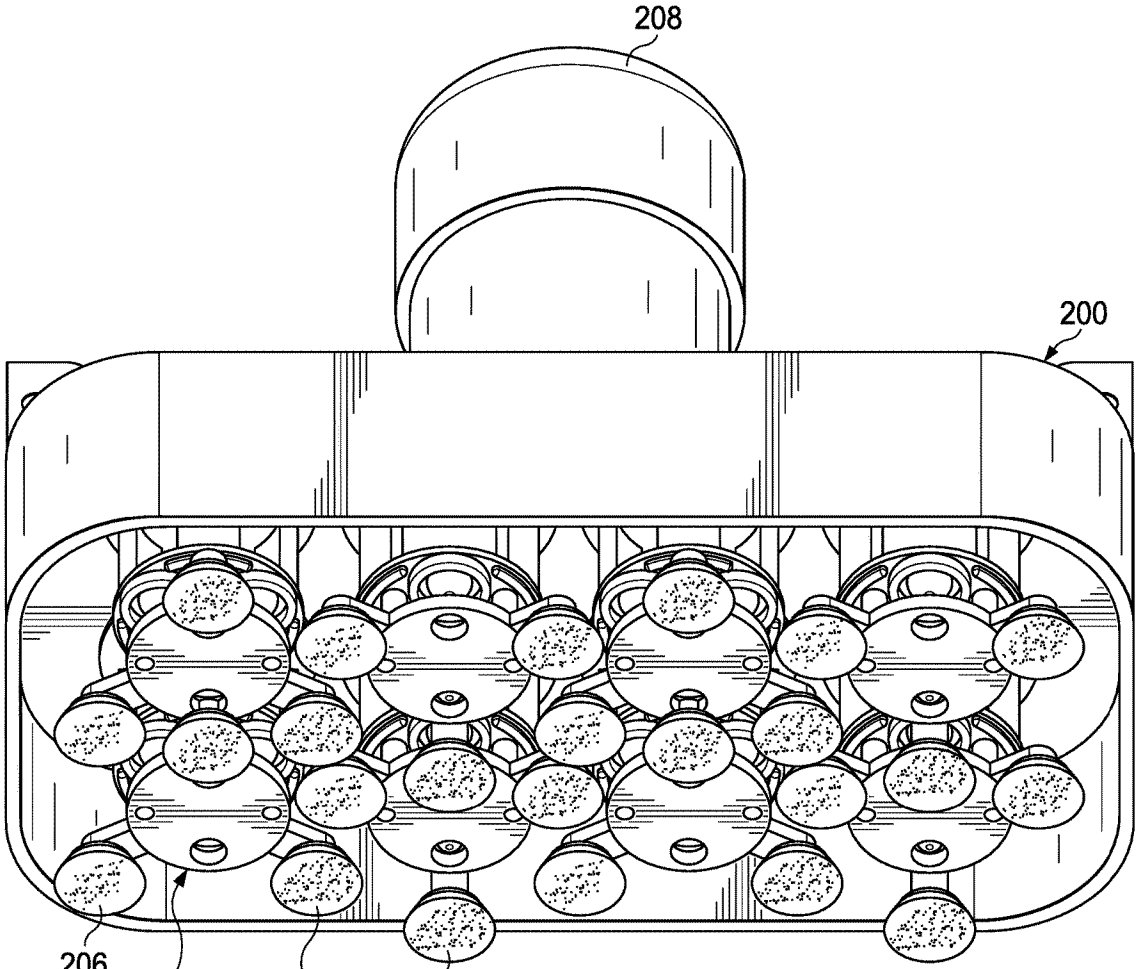
FIG. 4D is a bottom perspective view of an example grinding head.

FIG. 3 is an upper side view of the example floor treatment system 100, and shows the grinding heads 200 connected to the support frame 104, where the support frame 104 is connected to the vehicle 108. FIG. 4A is a schematic top view of the support frame 104 and grinding heads 200, and FIGS. 4B-4C are schematic partial top views of portions of the support frame 104 of FIG. 4A. Each grinding head 200 is independently mounted on the support frame 104, for example, using brackets. Each grinding head 200 is also removable from the support frame 104, and is adjustable on the support frame 104 in that the grinding head 200 can be mounted at a varying height and/or location on the support frame 104. In some instances, the grinding heads 200 can float when connected to the support frame, in that the grinding heads 200 can mount to the support frame 104 with a vertical float. For example, one or more of the grinding heads 200 can mount to the support frame such that they are rigidly mounted in the horizontal and lateral directions (i.e., laterally and longitudinally), but the grinding head(s) 200 is free to float vertically (e.g., perpendicular to the floor surface) during a grinding operation. Each grinding head 200 includes a head frame 202 with bracket attachments (e.g., to attach the grinding head 200 to the support frame 104), one or more grinding surfaces 204 proximate a first, bottom end of the grinding head, and a motor 208 configured to move the one or more grinding surfaces 204. In certain instances, the grinding surfaces are gear-driven, for example, instead of belt driven as gears can be less prone to failure and maintenance than belts. The grinding surfaces 204 are configured to rotate and engage a floor surface. In the example system 100 of FIG. 4A, the grinding surfaces 204 are shown schematically as circular discs with three cutting elements 206 mounted on, or integral to, each of the circular discs. FIG. 4D is a bottom perspective view of an example grinding head 200, showing the example grinding surfaces 204 and respective cutting elements 206 of the grinding surfaces 204. In some examples, the cutting elements 206 include circular, semicircular, or straight-edged cutters having a substantially or completely flat surface profile that is parallel to or slightly angularly offset from a floor surface that the cutters are configured to engage. The slight angular offset (e.g., between zero and 15 degrees) of the cutter profile from a flat floor surface can vary, for example, based on operation type (e.g., grinding, polishing, or other). The cutting elements 206 can take a variety of forms. For example, the cutting elements 206 can include diamond cutters, carbide cutters, and/or other cutter material types with sufficient hardness to grind and/or polish a floor surface, for example, substantially without chipping or breaking. The grinding heads 200 are mounted on the support frame 104 such that, in operation, the cutting elements 206 on the grinding surfaces 204 engage a floor surface. FIG. 4D shows eight grinding surfaces and a corresponding 24 cutting elements 206 per grinding head 200. However, the number of grinding surfaces 204 and/or cutting elements 206 can vary. For example, the grinding head 200 can include up to 24 cutting elements 206, such as 10, 12, 18, or another number of cutting elements 206 per grinding head 200.

In some examples, the support frame 104 of the example system 100 can support up to seven grinding heads 200, and each grinding head can include grinding surfaces supporting twenty-four cutting elements 206 per grinding head 200. In other words, the example system 100 can support up to 168 cutting elements 206 supported by up to seven grinding heads 200 mounted on the support frame 104. In the example system 100 of FIG. 3, each motor 208 is configured to rotate the grinding surfaces 204 of its respective grinding head 200. In some implementations, a motor can control grinding surfaces of more than one grinding head. The motors 208 can vary in type, for example, in that the motors 208 can include electric motors, hydraulic motors, and/or other types of motors. In some examples, the motor 208 of one or more of the grinding heads 200 includes a thirty-horsepower electric motor.

The grinding heads 200 can be mounted to the support frame 104 in a variety of patterns and orientations. For example, FIGS. 3 and 4A show the grinding heads 200 mounted on the support frame 104 in a zig-zag pattern between a lateral left side of the support frame 104 and a lateral right side of the support frame 104. The zig-zag pattern includes a staggered layout of the grinding heads 200, for example, such that three grinding heads 200 are aligned in a first row at a front end of the support frame 104 with lateral gaps between the three grinding heads 200, and four other grinding heads 200 are aligned in a second row behind the first row of grinding heads and adjacent to the gaps between the three grinding heads 200 of the first row. In this example pattern, the grinding surfaces 204 of the respective grinding heads 200 cover a continuous area along the lateral width of the support frame 104. For example, the grinding heads 200 are positioned to have sufficient overlap between the grinding heads 200 to ensure complete floor grinding coverage during operation of the system 100. The staggered, zig-zag pattern can, in some examples, ensure there are no lateral gaps between grinding surfaces of the grinding heads 200, for example, as the vehicle 108 moves forward (e.g., in a longitudinal direction). In some examples, the grinding heads 200 are oriented to cover a grinding width between 40 inches and 21 feet. In other words, the grinding heads 200 can be disposed on the support frame 104 to cover a continuous width of up to 21 feet of grinding and/or polishing width. The grinding heads 200 can be oriented in other configurations, as well. In some implementations, the system 100 includes three grinding heads 200 aligned in the first row at the front end of the support frame 104 with less than four (e.g., 0, 1, 2, or 3) grinding heads 200 in the second row behind the first row of the support frame 104. In certain implementations, any number of grinding heads 200 (e.g., up to seven) can be positioned in any position or configuration of the seven grinding head locations on the support frame 104.

During operation of the system 100, one or more or all of the grinding heads 200 can be simultaneously operable. In some instances, one or more grinding heads can be inoperable, for example, to avoid one or more areas of grinding and/or polishing, such as to avoid a drain or other more fragile element of a floor surface. In some examples, one to seven of the grinding heads 200 are operable during a grinding and/or polishing operation of the system 100. For example, one, two, three, four, five, six, or seven grinding heads 200 may operate at one time, while six, five, four, three, two, one, or zero grinding heads 200, respectively, are inoperable, or turned off.

In some implementations, the system 100 can include one or more weight trays 216 disposed on at least one of the grinding heads 200, for example, to provide an additional downforce on at least one of the grinding heads 200 as it engages a floor surface during a grinding and/or polishing operation. FIG. 3 shows two weight trays 216 on each grinding head 200 on either side of the motor 208. However, any number of the grinding heads 200 can include 0, 1, 2, or more weight trays 216 each. The weight trays 216 can hold weights to provide or contribute to the additional downforce on the grinding heads 200. The downforce on one or more of the grinding heads 200 can vary, for example, based on a grinding operation or a polishing operation. For example, more downforce on one or more of the grinding heads 200 may be desired during a grinding operation than a polishing operation. Alternatively, more downforce on one or more of the grinding heads 200 may be desired during a polishing operation than a grinding operation. The downforce on each grinding head 200 can vary, for example, based on the weight of the grinding head 200 itself, and based on any added weight from a weight tray 216. For example, each grinding head 200 can include a weight tray 216 that holds up to 240 pounds. Also, each grinding head 200 can weigh up to 1200 pounds by itself. Thus, each grinding head 200 plus weights on a respective weight tray 216 can weigh up to 1440 pounds.

The support frame 104 connects to the vehicle 108 at a longitudinally front end of the vehicle 108, and the vehicle 108 is configured to push the support frame 104 with the grinding heads 200 mounted to the support frame. In some implementations, the support frame 104 rotatably connects to the vehicle 108 such that the support frame is free to pivot about a lateral axis A-A. In certain instances, the pivot connection about lateral axis A-A between the support frame 104 and the vehicle 108 allows the support frame 104 and the mounted grinding heads 200 to float on a floor surface without rigidly attaching to the vehicle 108, while still allowing the vehicle 108 to push and direct the support frame and grinding heads during operation. The rotatable connection of the support frame 104 to the vehicle allows the support frame 104 and the mounted grinding heads 200 to pivot vertically, upwards or downwards, relative to the vehicle 108. This rotatable connection can promote a consistent and flat grinding surface of the grinding heads 200 against a floor in uneven, rounded, or otherwise inconsistent floor surface. For example, in a curved floor surface, the grinding heads 200 on the support frame 104 can maintain flat engagement with a floor surface even when a vehicle moves along an adjacent portion of the floor surface that is not parallel to or consistent with the grinding surface. In other implementations, the support frame 104 rigidly mounts to the vehicle 108, for example, and the vehicle 108 can contribute to a downforce acting on the grinding heads 200.

In some implementations, the support frame 104 is removably connected to the vehicle 108, for example, by a hitch pin system. For example, during a grinding operation, the vehicle 108 can support a first support frame holding a number of (e.g., five) grinding heads configured to grind a floor surface. At a conclusion of the grinding operation, the vehicle 108 can disconnect from the first support frame holding the five grinding heads, and connect a second support frame holding a number of (e.g., seven) polishing heads (e.g., grinding heads configured to polish a floor surface) and proceed with a polishing operation.

The support frame 104 can take a variety of forms and shapes. The example support frame 104 of FIG. 4A includes two main lateral bars 210 extending laterally outward from a connection point on the vehicle 108, and three box frames 212 extending longitudinally forward from the main lateral bars 210. FIG. 4A shows main lateral bars 210 as two lateral bars; however, the support frame can include a single lateral support bar alternatively or in addition to the two main lateral bars 210. Grinding heads 200 are disposed in the area between a first pair of adjacent box frames 212, in the area between a second pair of adjacent box frames 212, laterally outward of the laterally outermost box frames 212, and longitudinally forward of each box frame 212. In some examples, such as the example support frame 104 of FIG. 4A, the support frame 104 includes outrigger arms 214 extending substantially diagonally from the vehicle 108 (not shown) to a laterally outward portion of the support frame 104. The outrigger arms 214 can provide additional support and stability to the support frame 104, for example, for consistent and stable grinding operations.

In some implementations, the support frame 104 is adjustable, for example, in lateral length and/or positioning of connection points for the grinding heads. For example, the main lateral bars 210 can adjust (e.g., telescope) in length to achieve a laterally longer or shorter width of the support frame 104. In certain instances, the support frame 104 can measure up to twenty-two feet in width. In some examples, the box frames 212 can adjust in length separate from or in addition to the main lateral bars 210. The adjustability of the support frame 104 can accommodate a variety of grinding head sizes, grinding head orientations, and grinding head placements on the support frame 104. The support frame 104 can be made up of a variety of materials. For example, the support frame 104 can comprise stainless steel tubing (e.g., square tubing, circular tubing, and/or tubing made from other materials), other steel tubing, angled steel, or other steel material.

In some implementations, the floor treatment system 100 includes a water management system (not shown) that includes a water tank and a water supply hose. The water tank can be mounted directly on the vehicle 108 (e.g., directly on storage bed 112), or can be mounted on a tow cart and towed by the vehicle 108 during operation. In certain implementations, the water supply hose can be partially or completely integral to the vehicle 108. For example, the vehicle 108 can include a water hose input 300 at a first location on the vehicle 108, for example, at a rear of the vehicle 108, and a water hose output 302 at a second location on the vehicle 108, for example, at a front of the vehicle 108. Individual water lines can connect the water hose output 302 with one or more or all of the grinding heads 200, for example, to supply water to the grinding heads during a grinding and/or polishing operation of the floor treatment system 100. In certain implementations, the water management system is configured to permit wet grinding of the floor surface. For example, the water management system can supply water to the floor surface, the cutting elements 206 and cutters, or both, for wet-grinding the floor surface. The water management system can supply water in front of or onto the cutting elements 206 during operation of the system 100. In some examples, providing water to the floor surface, cutting elements 206, or both during a grinding and/or polishing operation can allow for more heavy duty material removal in a grinding and/or polishing operation, smoother operation of the grinding heads 200, and/or a smoother floor surface, for example, compared to a dry-grinding operation. In some implementations, the floor treatment system 100 includes a vacuum system (not shown) supported by the vehicle 108, for example, to suction dust, debris, water, and/or other material proximate the locations of the grinding heads 200. The vacuum system can be supported directly on the vehicle 108, mounted on a tow cart towed by the vehicle 108, or otherwise supported by the vehicle 108 to allow vacuum tubes to be disposed proximate to the grinding heads 200.

In some implementations, the example floor treatment system 100 includes one or more controllers to control the grinding heads 200. For example, one controller can control between one and seven grinding heads. In some examples, the floor treatment system 100 includes multiple controllers, where a first controller controls a first number of grinding heads and a second controller controls a second number of grinding heads. In certain instances, a first controller controls up to three grinding heads, a second controller controls up to three grinding heads, and a third controller controls one grinding head. The number of controllers and their respective number of controlled grinding heads can vary. Referring back to FIGS. 1 and 2, the example floor treatment system 100 can include one or more control panels 220 (two shown in FIG. 1), for example, between the power source 106 (e.g., generator) and a number of the grinding heads 200. The control panels 220 can be disposed proximate to the power source 106 and electrically connected between the power source 106 and the grinding heads 200. In some examples, the control panel(s) 220 house the one or more controllers. The controller(s) is configured to control various aspects of a grinding and/or polishing operation performed by the example floor treatment system 100. For example, the controller can independently or collectively control the movement (e.g., rotational speed or speeds) of the grinding heads 200, and in particular, the grinding surfaces 204, circular discs, and/or cutting elements 206. In some examples, the rotational speed or speeds of the grinding surfaces 204 vary by operation (e.g., grinding or polishing), floor surface, vehicle 108 speed, vehicle mode (e.g., straight line driving, turning), and/or other factors. For example, with the vehicle 108 driving in a straight line, the rotational speeds of the grinding surfaces 204 of all of the grinding heads 200 can be constant; whereas, during a turning movement of the vehicle 108, a radially outward grinding head can have a higher (or lower) grinding surface rotational speed than a grinding surface rotational speed of a radially inward grinding head.

In some implementations, the controller(s) is communicably coupled to the vehicle 108 (e.g., the drive system, operator controls, and/or other controls of the vehicle 108), the water management system, vacuum system, and/or other aspects of the floor treatment system 100. The controller can be configured to control the grinding or polishing speeds of one or more or all of the grinding heads, a speed of the vehicle 108, and/or a flow rate of water from the water management system to the grinding heads. For example, the controller can be configured with predefined operating functions, for example, such that the floor treatment system 100 can be set to run a first particular function with minimal or no operator control. The first particular function can include a predefined grinding surface speed for one or more of the grinding heads, a predefined vehicle speed, and/or a predefined vehicle direction. In certain instances, the controller can measure and provide speed and/or load readings of the grinding heads, individually or collectively. The readings can be displayed on an indicator on the vehicle, for example, that can be read and/or interpreted by an operator of the vehicle. The vehicle can include a display system that includes one or more indicators, for example, that displays information from aspects of the floor treatment systems described herein. Example aspects include rotational speed of the grinding surfaces of the grinding heads, vehicle speed, flow rate of water from the water management system, electrical loads on the grinding heads, electrical outputs of the power source or generator, and/or other aspects.

Figure 5A:
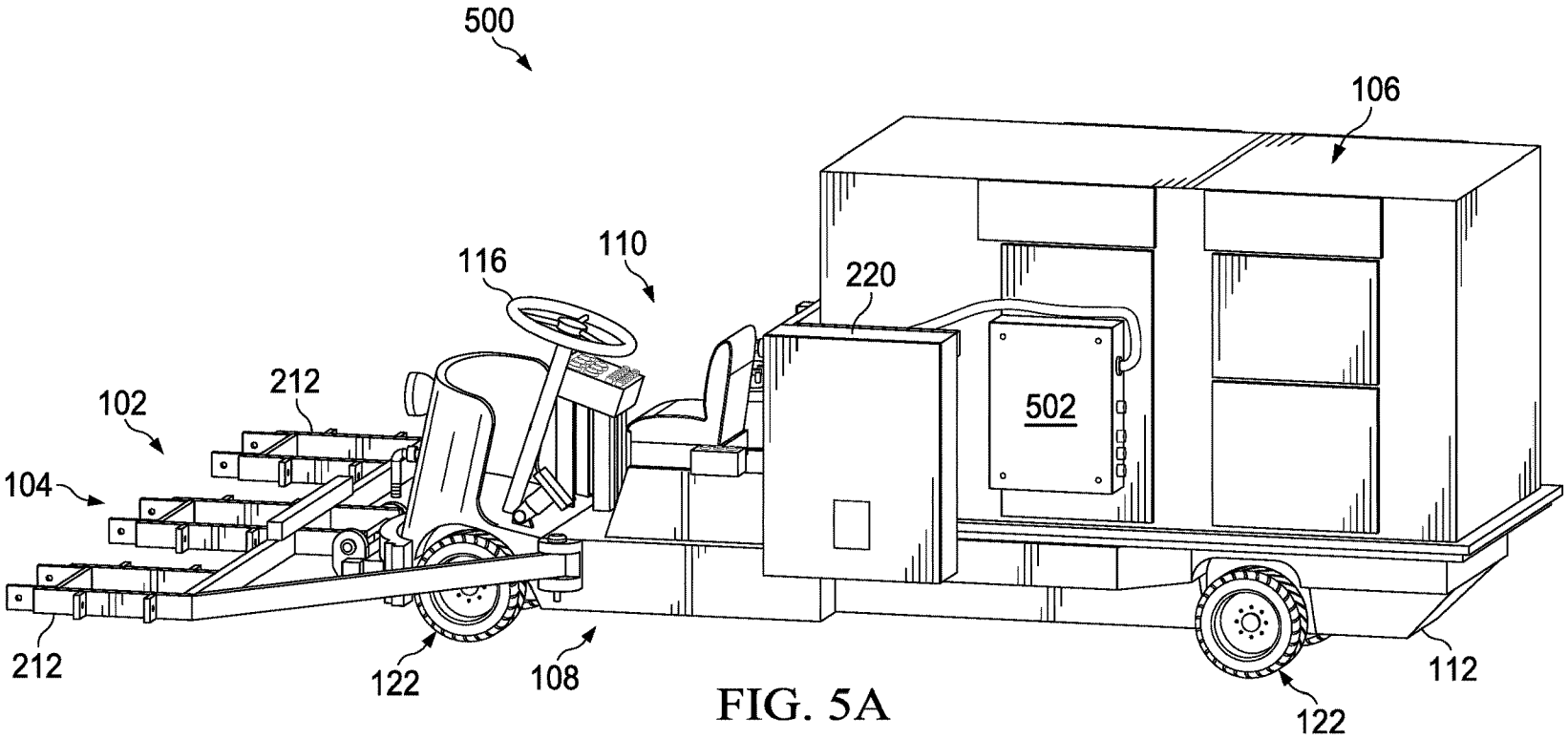
FIG. 5A is a side view of an example floor treatment system.
Figure 5B:
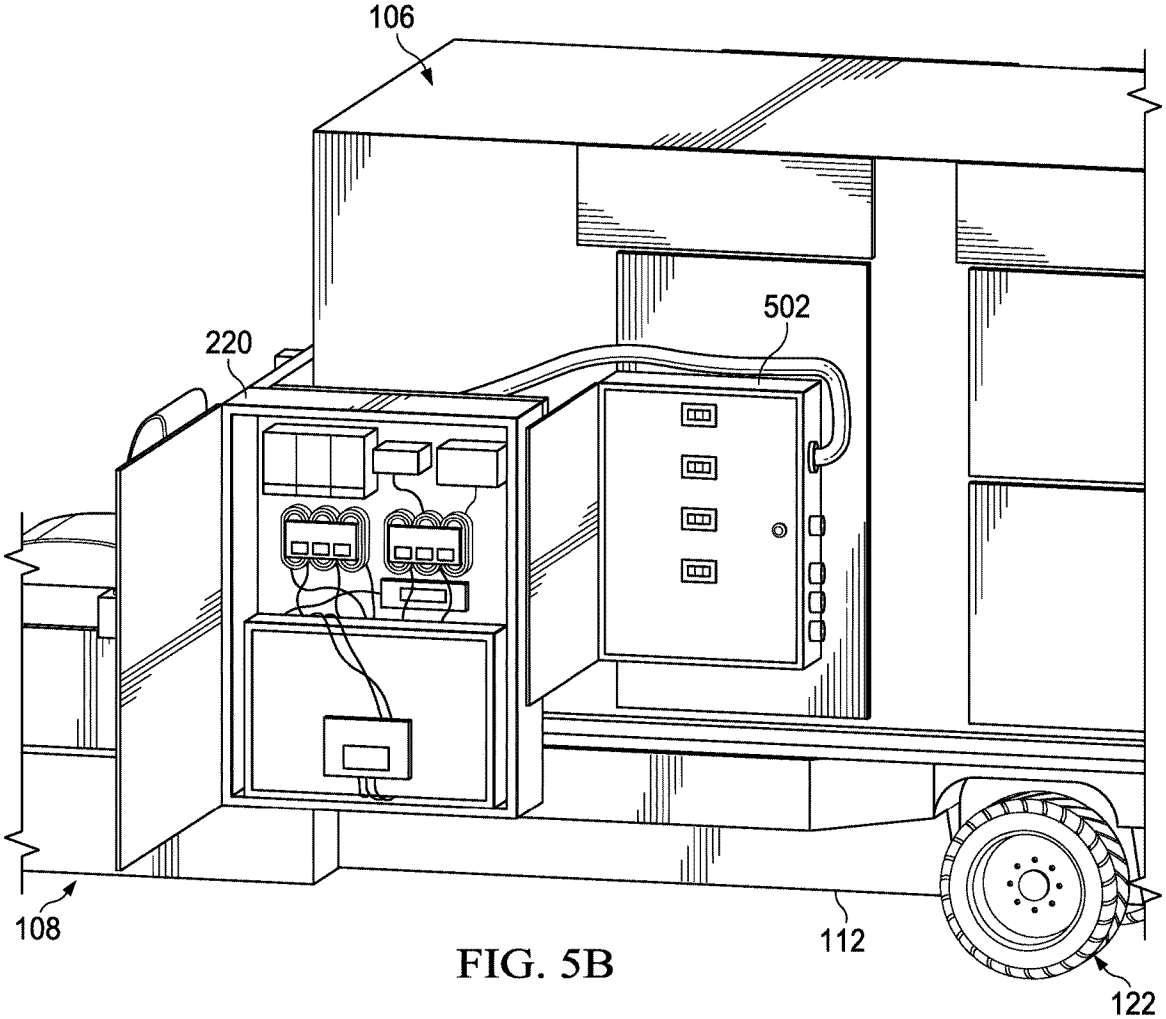
FIG. 5B is a close-up side view of an example floor treatment system with door panels of a breaker box and a control panel in an open position.

FIG. 5A is a side view of an example floor treatment system 500. The floor treatment system 500 is the same as the floor treatment system 100 of FIGS. 1-4D, except that the example floor treatment system 500 includes a breaker box 502 connected to the power source 106. FIG. 5B is a close-up side view of the example floor treatment system 500 with door panels of the breaker box 502 and the control panel 220 in an open position. The breaker box 502 can limit an electrical output (e.g., voltage or current output) from the power source 106 (i.e., generator) to the grinding heads. The breaker box 502 can limit an electrical output from the power source 106 to the grinding heads, for example, at 200 amps, 250 amps, or another current limit value, and/or limit an electrical output to the controller(s), for example, at 60 amps, 100 amps, and/or another current limit value. The breaker box 502 can be disposed adjacent to or otherwise proximate to the power source 106, for example, to reduce any loss in electrical output between the power source 106 and the breaker box 502, and between the breaker box 502 and the grinding heads.

In some examples, the breaker box can include two 100 amp breakers, where a first of the 100 amp breakers feeds a first controller, and a second of the 100 amp breakers feeds a second controller. The first controller and the second controller can each control between one and three grinding heads. In certain examples, the breaker box can include two 60 amp breakers, where a first of the 60 amp breakers is dedicated to a small controller controlling one grinding head, and the second of the 60 amp breakers is a spare to tap into any other equipment (e.g., a 480V 3-phase equipment) as desired.

A number of implementations have been described. Nevertheless, it will be understood that various modifications may be made without departing from the spirit and scope of the disclosure.

What is claimed is:

1. An apparatus for treating a floor surface, the apparatus comprising:

a floor grinder-polisher system comprising a support frame and a plurality of grinding heads mounted on the support frame, wherein each grinding head in the plurality of grinding heads comprises a grinding surface configured to rotate and engage a floor surface and wherein the support frame is adjustable in length between a first lateral side and a second, opposite lateral side of the support frame;

a power source connected to the plurality of grinding heads and configured to supply power to the plurality of grinding heads;

a controller configured to control the plurality of grinding heads; and a vehicle connected to the support frame and configured to support the power source.

2. The apparatus of claim 1, wherein the controller is configured to independently control a rotational speed of each grinding surface of the plurality of grinding heads.

3. The apparatus of claim 1, wherein each grinding head in the plurality of grinding heads comprises a motor configured to rotate a respective grinding surface of each grinding head.

4. The apparatus of claim 3, wherein the motor is an electric motor.

5. The apparatus of claim 1, wherein the grinding surface of one grinding head in the plurality of grinding heads comprises about 24 diamond cutters.

6. The apparatus of claim 1, wherein each grinding head of the plurality of grinding heads is independently mounted on the support frame.

7. The apparatus of claim 1, wherein each grinding head is adjustable on the support frame.

8. The apparatus of claim 1, wherein each grinding head of the plurality of grinding heads is removably connected to the support frame.

9. The apparatus of claim 1, wherein the plurality of grinding heads comprises at least five grinding heads mounted on the support frame.

10. The apparatus of claim 9, wherein three or more grinding heads of the at least five grinding heads are disposed on the support frame in a staggered, zig-zag pattern.

11. The apparatus of claim 1, further comprising at least one weight tray disposed on at least one grinding head of the plurality of grinding heads, the at least one weight tray configured to provide an additional downforce on the at least one grinding head of the plurality of grinding heads.

12. The apparatus of claim 1, wherein the support frame is removably connected to the vehicle.

13. The apparatus of claim 12, wherein the support frame removably connects to the vehicle with a hitch pin system.

14. The apparatus of claim 1, wherein the support frame rotatably connects to the vehicle.

15. The apparatus of claim 1, wherein the support frame comprises extendible arms configured to adjust the length of the support frame.

16. The apparatus of claim 1, further comprising a water management system comprising a water tank and a water supply hose, the water management system configured to supply water to the floor grinder-polisher system for a wet-grinding operation.

17. The apparatus of claim 16, wherein the water supply hose is at least partially integral to the vehicle.

18. The apparatus of claim 16, wherein the water tank is disposed on a tow cart configured to be towed by the vehicle.

19. The apparatus of claim 16, wherein the controller is configured to control a flow rate of water supplied to the plurality of grinding heads from the water management system.

20. The apparatus of claim 1, wherein the controller is configured to control at least one of a speed of the plurality of grinding heads or a speed of the vehicle.

21. The apparatus of claim 1, wherein the controller is configured to provide speed and load readings of the plurality of grinding heads to an indicator on the vehicle.

22. The apparatus of claim 1, wherein each grinding head in the plurality of grinding heads comprises a 30 horsepower electric motor, and the power source comprises a 200 amp to 250 amp generator.

23. A method for treating a floor surface, the method comprising:

supporting, with a vehicle, a floor grinder polisher system and a power source, the floor grinder polisher system comprising a support frame and a plurality of grinding heads mounted on the support frame, wherein the support frame is adjustable in length between a first lateral side and a second, opposite lateral side of the support frame and each grinding head in the plurality of grinding heads comprising a grinding surface configured to rotate and engage a floor surface;

supplying power, with the power source, to the plurality of grinding heads;

engaging, with the plurality of grinding heads, a floor surface; and controlling, with a controller, a speed of the plurality of grinding heads.

24. The method of claim 23, wherein controlling a speed of the plurality of grinding heads comprises controlling, with the controller, a rotational speed of the grinding surfaces of the plurality of grinding heads.

25. The method of claim 23, wherein controlling a speed of the plurality of grinding heads comprises independently controlling, with the controller, each grinding head of the plurality of grinding heads.

26. An apparatus for treating a floor surface, the apparatus comprising:

a floor grinder-polisher system comprising a support frame and at least one grinding head removably connected to the support frame, wherein the support frame is adjustable in length between a first lateral side and a second, opposite lateral side of the support frame and wherein the at least one grinding head comprises a grinding surface configured to rotate and engage a floor surface;

a power source connected to the floor grinder-polisher system and configured to supply power to the at least one grinding head;

a controller configured to control the plurality of grinding heads; and a vehicle connected to the support frame and configured to support the power source.

27. The apparatus of claim 26, wherein the support frame is removably connected to the vehicle.

28. The method of claim 23, wherein the support frame comprises extendible arms configured to adjust the length of the support frame.

29. The apparatus of claim 26, wherein the support frame comprises extendible arms configured to adjust the length of the support frame.

* * * * *